United States Patent [19]

Ts'ao

[11] Patent Number: 4,924,626

[45] Date of Patent: May 15, 1990

[54] DEVICE FOR AUTOMATICALLY OPENING AND CLOSING A DOOR

[76] Inventor: Si-Ling Ts'ao, Taipei, Taiwan

[21] Appl. No.: 321,010

[22] Filed: Mar. 9, 1989

[51] Int. Cl.[5] ..... E05F 11/04

[52] U.S. Cl. ..... 49/347; 49/32; 49/280; 49/301

[58] Field of Search ..... 49/347, 324, 280, 301, 49/357, 32

[56] References Cited

U.S. PATENT DOCUMENTS

| | | | |
|---|---|---|---|
| 263,771 | 9/1882 | Derr | 49/301 |
| 1,267,307 | 5/1918 | Becker | 49/301 |
| 1,328,979 | 1/1920 | Becker | 49/347 X |
| 2,186,825 | 1/1940 | Dome | 49/32 X |
| 2,549,451 | 4/1951 | Gossling | 49/32 |
| 2,800,323 | 7/1957 | West et al. | 49/32 |
| 2,971,755 | 2/1961 | Green | 49/347 |
| 3,332,472 | 7/1967 | Wiegand | 49/347 X |
| 3,857,197 | 12/1974 | Reddy et al. | 49/280 X |
| 4,616,444 | 10/1986 | Taylor | 49/347 |

*Primary Examiner*—Philip C. Kannan

*Attorney, Agent, or Firm*—Robert T. Gammons

[57] ABSTRACT

A device for automatically opening and closing a door by turning the door though an angle of 90° from an open to a closed position and vice versa.

17 Claims, 7 Drawing Sheets

| STATES | | ACTION |
|---|---|---|
| FF2 | FF1 | |
| 0 | 0 | NONE |
| 0 | 1 | OPEN |
| 1 | 0 | CLOSE |
| 1 | 1 | OPEN |

DEVICE FOR AUTOMATICALLY OPENING AND CLOSING A DOOR

BACKGROUND OF THE INVENTION

This invention relates to a device for automatically opening and closing a door by turning the door through an angle of 90° from an open to a closed position and vice versa.

At the present, a conventional door which rotates 90° to open by a user and either closes by hand or an automatic door closing device is not convenient for anyone carrying heavy weights such as babies, etc. to open because such a door is often quite heavy. For doors without the automatic door closing device, the door is often left open because nobody closes it.

The first object is to disclose a device which performs the action of door opening and closing automatically to free the hands of users to carry packages or babies or for those people who are elderly or have a handicap or to avoid the heavy force required to open doors installed with automatic closing devices.

The second object is to disclose a device which is simple and may be installed on the existing door easily by anyone without any need to change the structure of the door.

The third object is to disclose a device which may be used to control the opening and closing of doors at remote positions to permit only desired persons to pass the doors.

The fourth object is to provide an electrically or electronically-controlled device to replace the conventional mechanical device to perform the automatic closing function of a door.

The fifth object is to provide an electrically or electronically-controlled device to open a door installed with a conventional mechanical type of automatic door closing unit to reduce the force required by the user.

The sixth object is to provide an electrically or electronically-controlled device to open or close windows at high levels which cannot be easily reached.

SUMMARY OF THE INVENTION

A door opening and closing device for a door hinged at one vertical edge for swinging movement from a closed position adjacent one wall to an open position adjacent a wall at right angles thereto and means for effecting swinging movement thereof comprising anchoring means fixed to one wall adjacent the free edge of the door in its closed position, a first roller mounted to said one wall adjacent the hinged edge of the door, a second roller mounted to said other wall adjacent the free edge of the door when the latter is open, a rope fixed at one end to the free edge of the door and extending therefrom through said anchoring means about said first roller, about said second roller, and back to the free edge of the door where it is fixed to said free edge of the door, and means for traversing the rope in clockwise and counterclockwise directions to alternatively open and close the door. The means for traversing the rope comprises driven rollers about which the rope is wound and there is means interposed in the rope length for extending and contracting the rope in consonance with the opening and closing of a door, the aforesaid means comprising telescoping cylinders, pull means extending the cylinders and means connecting the rope to the respective ends of the cylinders. Several additional means will be disclosed hereinafter, some of which may be used for door opening only, some for door closing only, and others for door opening and closing purposes.

The invention will now be described in greater detail with reference to the accompanying drawings, wherein.

Figure 2:
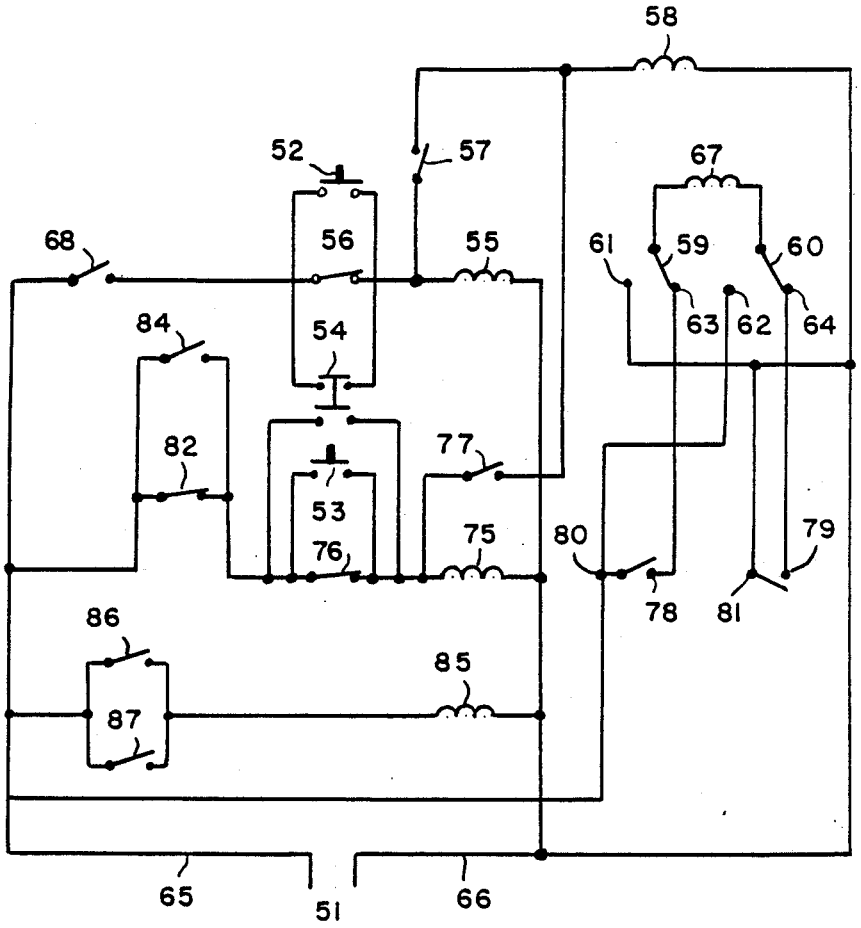
Figure 3A:
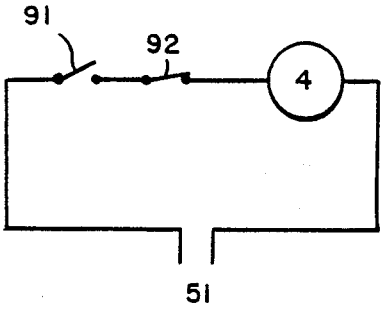
Figure 3B:
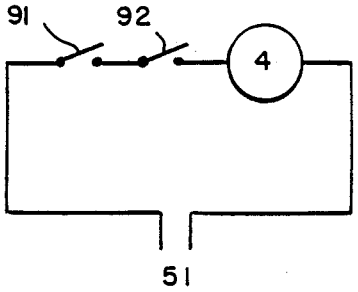
Figures 4A, 4B:
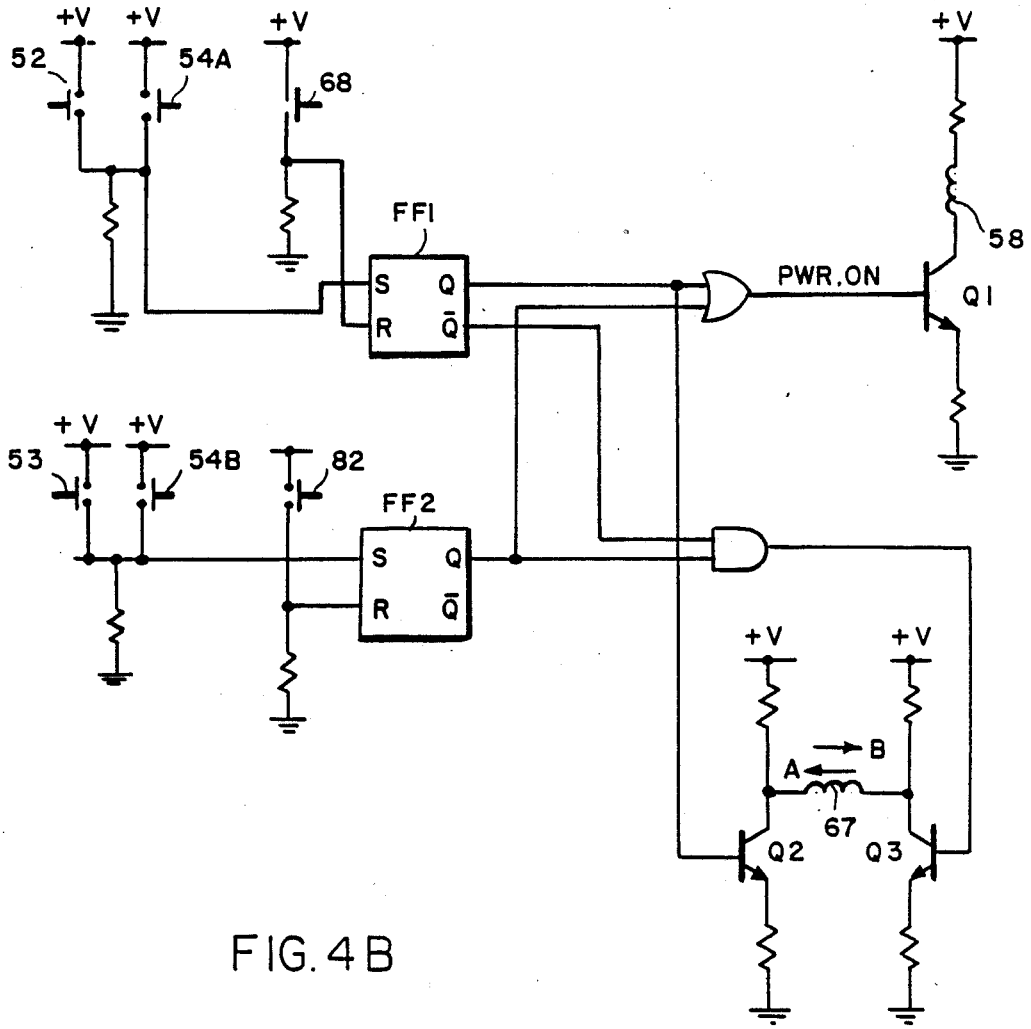
Figure 4C:
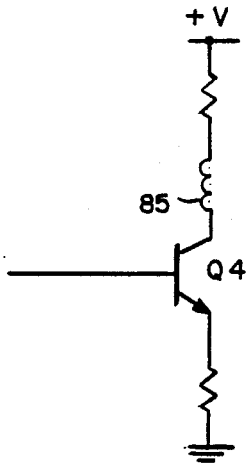
Figure 5:
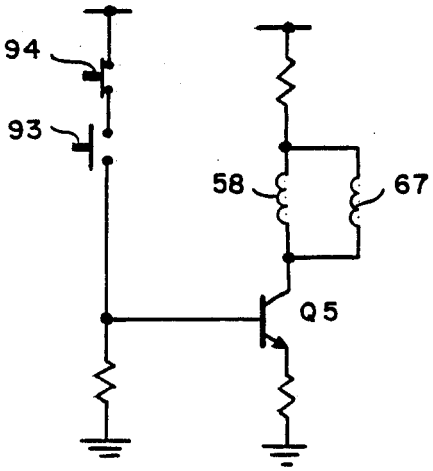
Figure 6:
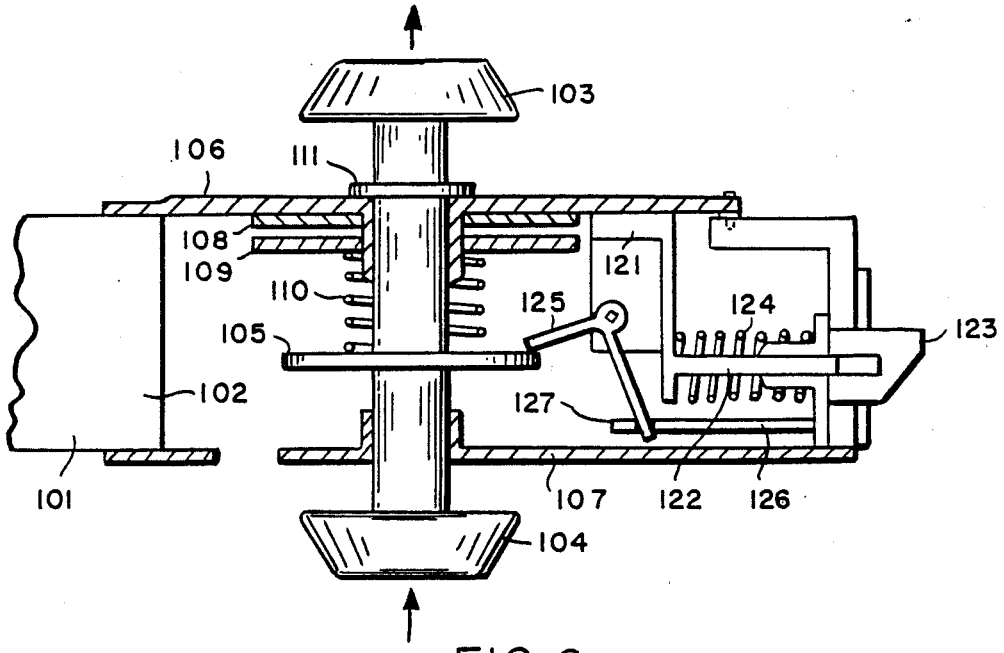
Figure 6A:
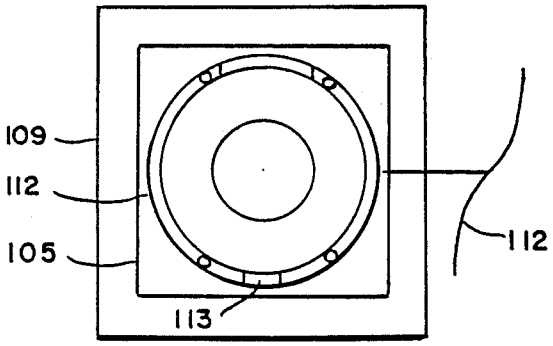
Figure 6B:
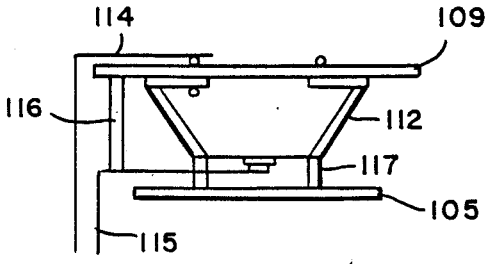
Figure 6C:
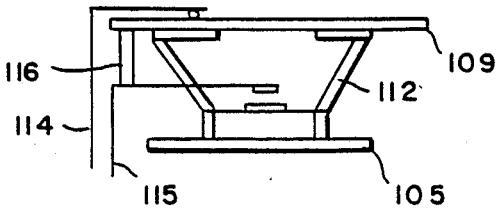
Figure 7A:
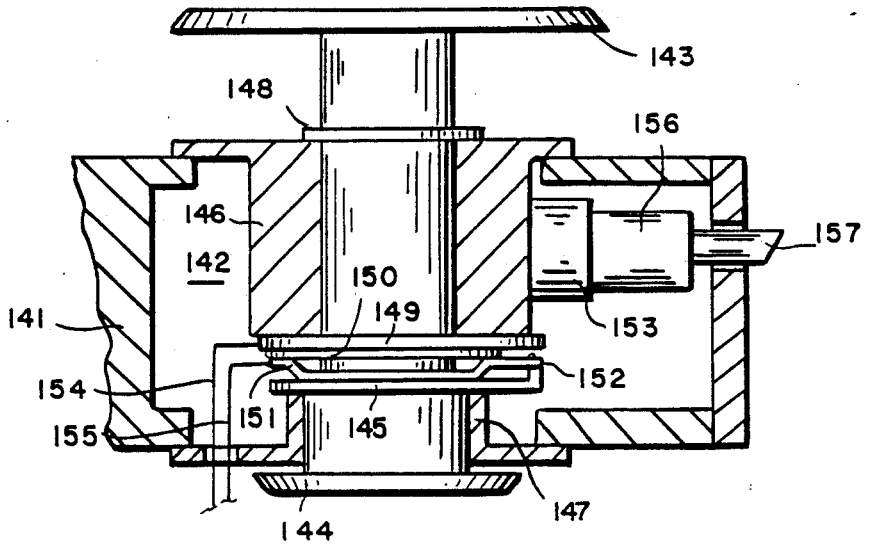
Figure 7B:
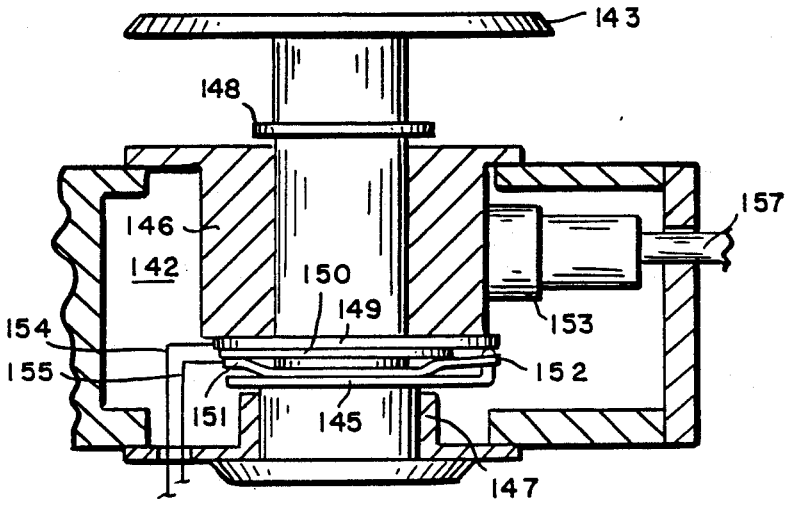
Figure 7C:
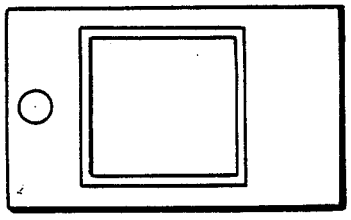

FIG. 2 discloses an electromechanical controlling mechanism and its circuit;

FIG. 3A discloses a circuit for the door closing device;

FIG. 3B discloses a circuit for the door opening device;

FIG. 4A lists the states;

FIG. 4B is an example of an electronic circuit that can be used to replace the electro-mechanical circuit of FIG. 2;

FIG. 4C is an example of the circuit that can be used with the electronic lock to replace the electro-mechanical lock circuit in FIG. 2;

FIG. 5 is an electronic circuit that may be used to replace the electro-mechanical circuit of FIG. 3A for closing the door only; a minor change in the circuit (not shown here) may be used to replace the circuit of FIG. 3B for door opening only;

FIGS. 6, 6A, 6B and 6C show an example of a mechanical type of a door sliding switch with lock; and FIGS. 7A, 7B and 7C show an example of a combined electric and electronic type of a door sliding switch with lock.

Figure 1:
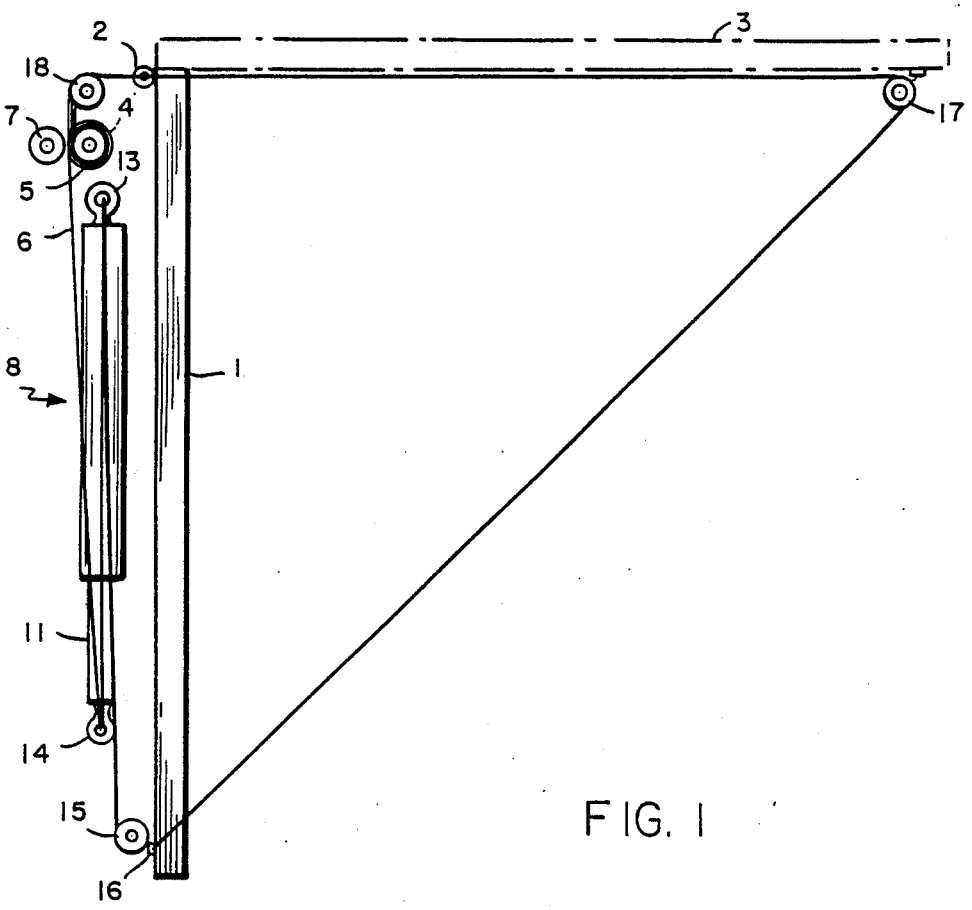
FIG. 1 represents the top view of a door and the door opening and closing device.

Referring to FIG. 1, a door 1 is represented in a closed position with its hinges 2 fixed to a wall, not shown. When open, the door is shown in dot and dash lines in a position 3. A motor 4, FIG. 1A, may rotate clockwise or counterclockwise by controlling the direction of the flow of the current through the winding or similar method. The motor 4 may be mounted vertically, FIG. 1, and has a pulley 5 attached to one end. A rope 6 may be wrapped several times around the pulley 5 so that, when the motor rotates, the pulley 5 rotates to cause the rope 6 to run upward or downward as seen in FIG. 1. This operation may be made more positive by using a spring-biased roller 7 against the rope 6 to increase the friction between the rope and the pulley 5. A rope length adjuster 8, FIGS. 1 and 1B, automatically adjusts the tension and the length of the rope when the door has completed the opening or closing operations. The rope length adjuster, FIG. 1B, has an outer hollow cylinder 9 fixed on the wall. Inside there is a slidingly-mounted hollow cylinder 11. Further inside the cylinder 11 there is a compressed coiled spring 12. Attached to the cylinder 9 is a rope ring 13. Attached to the cylinder 11 there is a rope ring 14. The rope 6 is wound through the ring 14, then back through the ring 13 and from thence through a fixed ring 15 on the wall. One end of the rope 6 is fixed to a knob 16 which is riveted to the door 1. The other end of the rope 6 goes around a roller 17 fixed on the wall, then passes around another roller 18 also fixed on the wall, and finally ends on the knob 16 again.

Figure 1A:
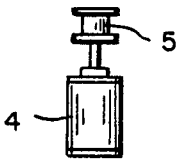
FIG. 1A is a plan view of the drive motor and pulley.
Figure 1B:
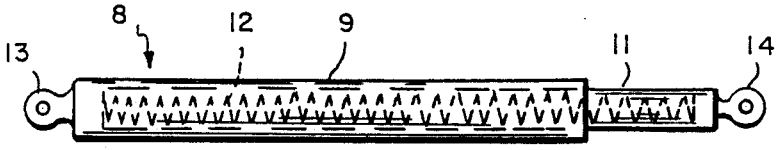
FIG. 1B is a plan view of the rope length adjuster.

When one wants to open the door, the motor 4, FIG. 1A, is caused to rotate counterclockwise, whereupon the rope 6 pulls the door open. During the opening operation, the active length of rope required increases. This is met by compressing the rope length adjuster 8. When the door is opened wide, the rope length adjuster expands again.

Figure 1C:
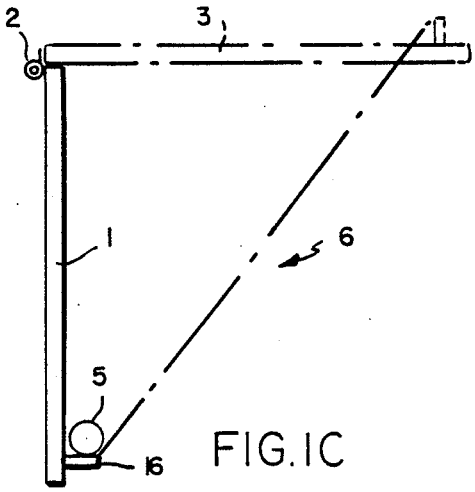
FIG. 1C represents the top view of an alternative door closing device.
Figure 1E:
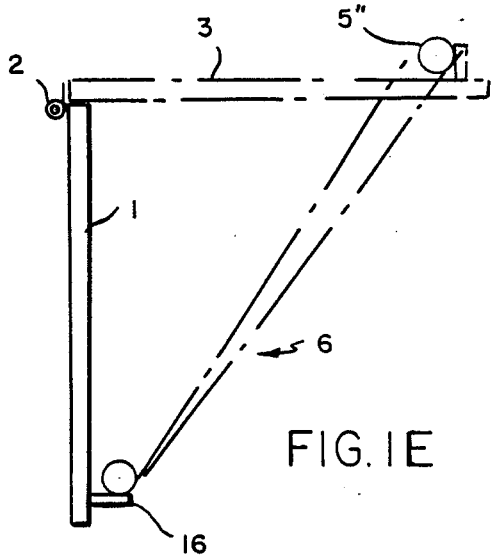
FIG. 1E represents the top view of a third alternative door opening and closing device.
Figure 1D:
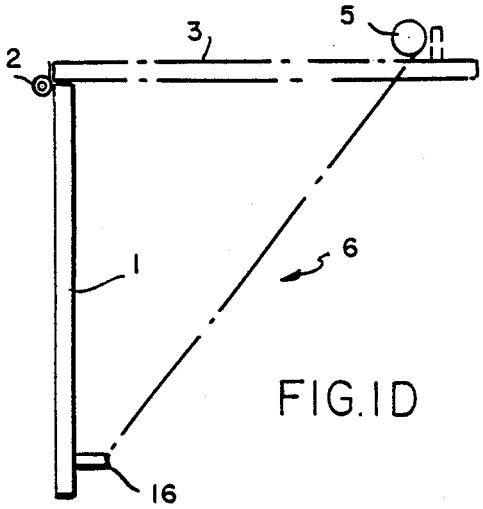
FIG. 1D represents the top view of a second alternative door opening device.
Figure 1F:
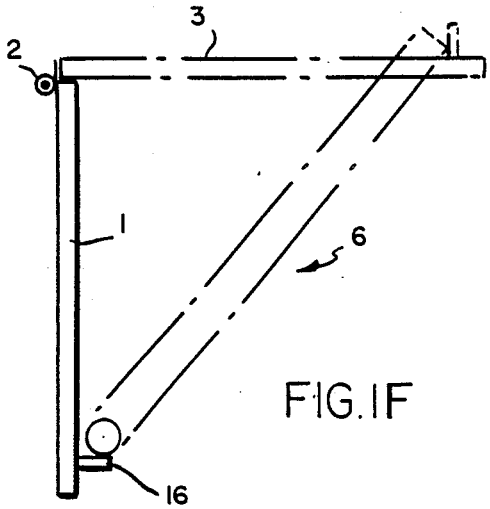
FIG. 1F represents the top view of a fourth alternative door opening and closing device.
Figure 1G:
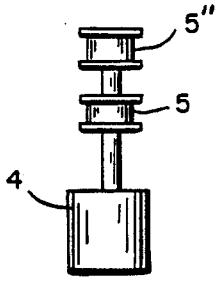
FIG. 1G is a plan view of one drive motor driving two pulleys.

Referring to FIGS. 1C, 1D, 1E, 1F and 1G, the reference characters represent the same parts as mentioned in the previous paragraphs. FIG. 1C is an automatic door closing device. When a person passes the door, the rope 6 will be extended, whereupon a circuit will be closed to cause the motor-driven pulley 5 (either directly or through a set of speed reduction gears) to pull the rope 6 to close the door. FIG. 1D depicts an automatic door opening device. The pulley 5 rotates to open the door when one wants to pass the door. This device may be used together with a mechanical type of door closing device. FIG. 1E depicts an automatic door opening and closing device. One motor and pulley 5 are used to open the door and another motor and pulley 5" are used to close the door. FIG. 1F depicts an automatic door opening and closing device. Two pulleys are used. One pulley 5 is driven in one direction by one motor 4, but the other pulley 5" is driven in a reverse direction by the same motor 4 running in a reverse direction. Control means is used to shift the pulleys so that only one pulley is engaged with the motor. Its basic concept is shown in FIG. 1G.

Referring to FIG. 2, there is shown a controlling electromechanical circuit which may perform the required function of opening or closing a door by rotating 90° wherein:

51 is a plug which may be plugged into a power source;

52 is a button switch for opening the door only;

53 is a button switch for closing the door only; and 54 is a button switch for opening and then closing the door.

When the button 52 is pressed temporarily, a relay 55 operates and its self-locking contacts 56 close, thus holding relay 55 in the operating condition. It also closes its contacts 57, thereby supporting the electric power to the winding 58 of the motor 4 shown in FIGS. 1 and 1A. The closing of the relay 55 also moves its contacts 59 and 60 to mate with the contacts 61 and 62, respectively. Now the electric power flows from the line 65, contacts 62, 60, through a winding 67 of the same motor 4, contacts 59, 61 and back to the line 66. The motor begins to rotate to open the door by the mechanism shown in FIG. 1. When the door rotates 90° or more to its wide open position, the door opens a switch 68 which is mounted on the wall. This opens the circuit to the relay 55, thereby disconnecting the power and stopping the rotation of the motor, keeping the door in its opened position.

When one wants to close the door, a button 53 is pressed temporarily and the relay 75 operates, thus closing its self-locking contacts 76. It also closes its contacts 77, thereby supplying the power to the motor winding 58 and moving its contacts 78 to 80, 79 to 81, respectively. Now the power flows from 65, 80, 78, 63, 59 through the motor winding 67 and contacts 60, 64, 79, 81 to 66. The current flows in a reversed direction. Therefore, the motor 4 rotates in a reverse direction, causing the door to be closed. A switch 82 is mounted on the wall and will be opened when the door closes. The power to the relay 75 is disconnected and all contacts are opened.

When one wants to open the door and let it close by itself, one just presses the button 54 temporarily. Now relay 55 operates and closes contacts 56,57 to supply the power to the motor winding 58. A set of contacts 84, also controlled by the relay 55, is placed in shunt with the door switch 82. This closes the circuit for the relay 75 through the button switch 54 and later through its self-locking contacts 76. The door is now opened by the motor 4 to the final wide-open position. Another switch 68 mounted on the wall is opened by the door, thereby releasing the relay 55. Although the contacts 84 are open now, the door switch 82 is closed and the relay 75 is still in an operating condition. The release of the relay 55 causes the power to flow in a reverse direction, thus the motor 4 rotates in a reverse direction to close the door.

An electric lock may be installed with this device to lock the door. It is represented by a coil 85, FIG. 2. Contacts 86 are controlled by the relay 55. Contacts 87 are controlled by the relay 75. When one wants to open the door, the switch 52 is pressed, causing the relay 55 to operate, thereby closing the contacts 86 and opening the door lock. When one presses the button 53, the operation of the relay 75 causes the contacts 87 to be closed, thereby operating the lock 85. Until the door is fully closed, the relay 75 releases, thereby releasing the lock and locking the door.

For automatic closing doors only, referring to FIG. 1, the basic mechanical design is the same, but the controlling circuit is shown in FIG. 3A.

The motor 4 and the plug 51, FIG. 3A, are the same as in FIG. 2. A switch 91 is controlled by the door. Its contacts open when the door is closed and its contacts close when the door is opened. Thus, the power is cut off when the door is closed. When the door is open, the power may be supplied to the motor if another contact 92 is in a closed position. This happens when the sliding door handle 103 shown in FIGS. 6 and 6B is not held. Now the motor will close the door automatically. When the door is pushed or pulled, the switch is opened, cutting off the power to the motor.

FIG. 3B is an automatic door opening circuit, switch 91 is the same switch as in FIG. 3A and contact 92 is the door sliding switch which may use the design of FIGS. 6 and 6C as an example. When one wants to open the door, one either pushes or pulls the door handle 103 or 104, thus closing the switch, and power is now supplied to the motor 4 and runs to open the door and a person needs only a little force, even when the door is mounted with a heavy mechanical automatic door closing device.

Referring to FIGS. 2, 3A and 3B, all switches and windings are numbered to be similar to those above. However, polarity of the switches and windings may be changed. A normally closed switch might now be a normally open switch.

FIG. 4A lists the states and FIG. 4B is an example of an electronic circuit that can be used.

52 is a button switch for opening the door only.

53 is a button switch for closing the door only.

54 is a button switch for opening and then closing the door.

This system has four states, as shown in state diagram 4A. Assume that the system is initially in state 00.

When button 52 is pressed temporarily, flip-flop (FF1) is set and the system goes into state 01. The signal PWR.ON goes high via an OR gate and electrical power is supplied to winding 58 via transistor Q1. At the same time, transistor Q2 is turned on and current flows through winding 67 in direction A. The door starts to open.

When the door reaches 90° or more to its wide open position, switch 68 is closed. This action resets FF1 and the system is again in initial state 00.

When button 53 is pressed temporarily, FF2 is set and the system goes into state 10. The signal PWR.ON goes high via the OR gate and electrical power is supplied to winding 58 via transistor Q1. At the same time, transistor Q3 is turned on and current flows through winding 67 in direction B. The door starts to close.

When the door closes, switch 82 is closed automatically. This action resets FF2 and the system is again in initial state 00.

When button 54 is pressed, switches 54A and 54B both are momentarily closed and FF1 and FF2 are both set. The system goes into state 11. The signal PWR.ON goes high via the OR gate and electrical power is supplied to winding 58 via transistor Q1. At the same time, transistor Q2 is turned on, and current flows through winding 67 in direction A. The door starts to open.

When the door reaches 90° or more to its wide open position, switch 68 is closed. This action resets FF1 and the system is in initial state 10. The signal PWR.ON stays high via the OR gate and electrical power is supplied to winding 58 via transistor Q1. At the same time, transistor Q3 is turned on (Q2 turns off) and current flows through winding 67 in direction B. The door starts to close.

When the door closes, switch 82 is closed momentarily. This action resets FF2 and the system is again in initial state 00.

An example of a circuit that can be used with the electronic lock is shown in FIG. 4C. All that needs to be done is to take the signal PWR.ON and tie that to transistor Q4. Winding 85 (electric lock) is turned on (normally off) whenever the door is opening or closing.

For a circuit that closes the door only, refer to FIG. 5. Switch 93 is open when the door is closed and closed when the door is open. Switch 94 is connected to the door handle. If someone is pushing on the door, 94 is open. Otherwise, it is closed.

Thus, the motor (windings 58 and 67) is turned on (via transistor Q5) only when no one is pushing on the door and the door is open. For a circuit that opens the door only, a minor change from FIG. 5 will work and further description is not shown here.

FIGS. 6, 6A, 6B, 6C and 6D show the basic design of a mechanical sliding door handle and switch combination, for example, either for closing or opening doors only.

FIG. 6 shows a cross-sectional view of the above device. 101 represents the sectional view of the part of the door 1 installed with this device. It is provided with a hole 102. 103 is a pulling handle for opening the door. 104 is a pushing handle for opening the door also. They are mounted to a common spindle. Between the handles, there is an insulator plate 105. 106 and 107 are two metallic plates for covering the hole 102 and are used as the support of the whole unit. They both have inward tubings extended into the hole for the sliding knobs of 103 and 104. 108 is an insulator washer mounted on the tubing portion of 106 for preventing the switch springs from being electrically grounded. 109 is an insulator supporting plate mounted next to 108. 110 is a coiled spring shown here (it may be a flat spring). It is used to push the handle inwardly, but its operation is limited by a stopper 111 fixed on 103.

In FIG. 6A, 109 is shown as a square. Upon it is mounted a circular spring 112 which is not shown in FIG. 6 for simplicity. 112 is riveted on 109. Its shape is also shown in FIGS. 6B and 6C. 113 is a contact point mounted on the center portion of the spring 112. 114 is a lead connected to the rivets for the spring 112 and is used as one terminal of the electric connection. 115 is another electric lead. It is spring-mounted on the insulator rod 116 which is fixed on the plate 109.

Upon the tip of the spring 115, a contact point is soldered. 117 represents two insulator rods fixed upon the plate 105 which is assumed to be transparent in FIG. 6A for easy illustration. When one pulls 103 or pushes 104, 105 will push the spring 112 upward.

When the door is installed with this type of electrically automatic door closing device, one wants to pass this door and stop the closing operation. One may push the handle 104 or pull the handle 103. The contacts of the spring 112 and 115 will be opened, as shown in FIG. 6B, because 105 pushes the contacts apart. The electric power to the motor is cut off and the motor stops the closing operation. One may open the door by hand easily. When one passes the door, one releases the handle, then the motor will do the door closing operation.

Doors installed with a mechanical type of automatic door closing device are often very heavy to open. An electric type of automatic door opening device may be added to reduce the force required to open it. When one pulls or pushes the handle, the contacts 112 and 115 will make contact, as shown in FIG. 6C, to let the motor run to open the door.

Doors are often installed with locks to keep doors in the closed state. It is necessary to release the lock before opening the door or closing the door. A mechanical example of a design suitable for the above purpose is shown in FIG. 6. 121 is a complicated mounting base. It is fixed on the cover 106. 121 has a Z-shaped arm with a square rod 122 used as the sliding guard for the lock 123. A spring 124 normally pushes the tip 123 outward to lock the door. 125 is a fork-shaped member mounted on 121. When one pulls 103 or pushes 104, the plate 105 moves upward to push one arm of 125 upward, thereby moving the arm leftward. 126 is a rod fixed on 123. It has a bent tip 127. When the second arm of 125 moves leftward, it also pushes the bent tip 127 leftward, thereby pulling the lock tip 123 inward to release the lock.

FIGS. 7A, 7B and 7C show the design of another sliding door switch with an IC controlling unit and an electric door locker.

FIG. 7A shows a cross-sectional view of the above device. 141 represents the sectional view of the door drilled with a hole 142. 143 is a pulling handle and 144 is a pushing knob. Both may have square cross section and holes inside. They are mounted together on a spindle and in between them is mounted an insulator plate 145. 146 and 147 represent large and small insulating covers and both have inward guards for the sliding movement of 143 and 144. The movement is small and limited by a stopper 148 fixed on 143. Mounted on the tubing portion of the cover 146 is a flat spring 149, a thin insulating sheet 150 and another flat spring 151. The center portion of 151 is convex outward, as shown in FIGS. 7A, 7B and 7C. The convex portion normally pushes the handle downward until the stop 148 meets the cover 146. These three pieces may have the shape as shown in FIG. 7C. The insulating sheet 150 is used to separate the conducting spring 149 and 151 electrically.

For automatic door opening, such as closing by the mechanical door closing device, the spring 149 is shorter than the spring 151. Normally, these two springs are open. When a person pulls 143 or pushes 144, a tip 152 fixed on the insulating plate 145 will push the spring 151 to touch the spring 149, thereby to control the operation of the motor 4 to open the door and reduce the force required by the person. The above springs are shown in FIG. 7A.

In FIG. 7B for the automatic door closing electrically, the door will be closed automatically as soon as it is opened, except either by one pulling or pushing the door handle. In such cases, the motor circuit is open because the spring 149 is pushed apart by 152.

An electronically-controlled and electrically-operated lock may be used. As shown in FIG. 7, a conventional IC package 153 is fixed to the insulator tubing 146. The leads 154 and 155 from the springs 149 and 151 are connected to the input of the IC 153. The output from 153 is used to control the solenoid 156 which has a plunger 157 used as the lock. Both the IC package 153, solenoid and plunger are well-known and no detailed description is required.

Foot switches may be used to replace hand-pressed buttons.

Foot switches may be covered with rugs knitted with OPEN, CLOSE, and OPEN AND CLOSE to save hand operations.

The device may be used for windows.

A time delay switch may be inserted into the circuit for delaying the operation of the door closing after opening.

An optical control device may be used instead of the mechanical or electronic switches to perform the door opening and closing functions.

What is claimed is:

1. A door opening and closing device for a door hinged for swinging movement from a closed position adjacent one wall to an open position adjacent a wall at right angles to the one wall and means for effecting swinging movement thereof, comprising a ring fixed to one wall adjacent the free edge of the door in its closed position, a first roller mounted to said one wall adjacent the hinged edge of the door, a second roller mounted to the other wall adjacent the free edge of the door when the latter is open, a rope fixed at one end to the free edge of the door and extending therefrom through the ring about the first roller, about the second roller, and back to the free edge of the door where it is fixed to the free edge of the door and means for traversing the rope in clockwise and counterclockwise directions to alternately open and close the door.

2. A door opening and closing device according to claim 1 wherein the means for traversing the rope comprises a driven roller about which the rope is wound.

3. A door opening and closing device according to claim 1 comprising means interposed in the rope length for extending and contracting the rope in consonance with the opening and closing of the door.

4. A door opening and closing device according to claim 3 wherein means interposed in the rope length for extending and contracting the rope in consonance with the opening and closing of the door comprise telescoping cylinders, spring means extending said cylinders and means connecting the rope to the respective ends of the cylinders.

5. A door opening and closing device according to claim 1 wherein said means for traversing the rope comprises a motor-driven pulley and circuitry for driving the motor and, hence, the pulley in one direction to open the door and in an opposite direction to close the door.

6. A door opening and closing device according to claim 5 wherein said circuitry includes switching means operable by movement of the door to its open position to stop rotation of the pulley to keep the door in its open position.

7. A door opening and closing device according to claim 5 comprising a touch switch operable to reverse the current flow through the motor to close the door.

8. A door opening and closing device according to claim 5 wherein said circuitry includes an electronic circuit comprising a flip-flop and OR IC's for driving said motor in one direction to open said door and another flip-flop and AND IC's for reversing the current to drive said motor in a reverse direction to close said door.

9. A door opening and closing device according to claim 5 wherein said circuitry includes switch means and operation of said switch means to drive said motor in one direction to open said door, and other switch means operable by the movement of said door to its open position to reverse the direction of rotation of said motor to close said door.

10. A door opening and closing device according to claim 9 wherein switch means include touch switches and relays.

11. A door opening and closing device according to claim 5 wherein said circuitry includes a relay-operated lock.

12. A door opening and closing device according to claim 5 wherein said circuitry includes an electronically-operated lock.

13. A door opening and closing device for a door hinged for swinging movement from a closed position adjacent one wall to an open position at right angles to said wall or vice versa and means for effecting swinging movement thereof, comprising a rope fixed to the free edge of said door, circuitry, a pulley and one motor to open said door and another pulley and motor to close said door.

14. A door closing device for a door hinged for swinging movement from an open position to a closed position and means for effecting swinging movement thereof, comprising a rope fixed to the free edge of said door, a pulley driven by a motor, spring contact means in a circuitry which opens when said door closes, but closes when said door opens, and a sliding door switch on a mounting base fixed to said door, sliding guards, a sliding member having knobs at both ends, a plate mounted on said sliding member, spring means to bias said plate to one extreme position, a set of spring contacts leading to the electric circuits and movement of said sliding member to the other extreme position by a user pushing or pulling on said door knob, an unlocking relay opens a door lock, said spring contacts open to open the electric circuit to stop the rotation of said motor to permit said door to be opened manually and said user to pass through said door and, after passing through the door, the user releases said door knob, permitting said sliding member to move back to the original extreme position to close said spring contacts to run said motor to close said door automatically, locking means to lock said door when said door is fully closed and spring spring contact means opens the electric circuit to stop said motor from running.

15. A door closing device according to claim 14 wherein said electric circuits include electronic circuits.

16. A door opening device for swinging doors, the closing operating being of a conventional mechanical type of automatic door closing unit, but the opening operation comprising a rope fixed to the free edge of said door, a pulley driven by a motor, a sliding door switch on a mounting base fixed to said door, sliding guards, a sliding member having knobs at both ends, a plate mounted on said sliding member, spring means to bias said plate to one extreme position, a set of spring contacts leading to the electric circuits, and movement of said sliding member to the other extreme position by a user pushing or pulling on said door knob, said spring contacts meeting to close the electric circuit to let said motor run to open said door to permit said user to pass through said door and, after the user passes the door, he releases said door knob to let said sliding member move back to its original position to open the electric circuit to stop the rotation of said motor and permit said mechanical door closing unit to close said door.

17. A door opening device according to claim 16 wherein said electric circuits include electronic circuits.

* * * * *